US006257660B1

(12) United States Patent
Calvey

(10) Patent No.: US 6,257,660 B1
(45) Date of Patent: Jul. 10, 2001

(54) FOLDABLE AND PORTABLE FURNITURE ASSEMBLY

(76) Inventor: Kacey J. Calvey, 1120 E. Congress St., Shorewood, WI (US) 53211

( * ) Notice: Subject to any disclaimer, the term of this patent is extended or adjusted under 35 U.S.C. 154(b) by 0 days.

(21) Appl. No.: 09/459,937

(22) Filed: Dec. 14, 1999

(51) Int. Cl.[7] ..... A47C 4/30; A47C 4/40

(52) U.S. Cl. ..... 297/16.1; 297/16.2; 297/17; 297/20; 297/32; 297/41; 297/55; 297/56; 297/258.1; 297/271.5; 297/271.6; 297/272.1

(58) Field of Search ..... 297/16.1, 16.2, 297/17, 32, 41, 55, 56, 258.1, 271.5, 271.6, 272.1, 20

(56) References Cited

U.S. PATENT DOCUMENTS

| | | | | |
|---|---|---|---|---|
| 117,351 | * | 7/1871 | Van Orden | 297/20 |
| 136,099 | * | 2/1873 | Russell | 297/20 |
| 150,371 | * | 4/1874 | Stewart | 297/20 |
| 165,745 | * | 7/1875 | McAleer | 297/32 X |
| 166,123 | * | 7/1875 | McAleer | 297/32 |
| 172,623 | * | 1/1876 | Golightly | 297/32 |
| 172,665 | * | 1/1876 | Sleight | 297/32 X |
| 178,663 | * | 6/1876 | Ovenden | 297/41 X |
| 184,260 | * | 11/1876 | Oberg | 297/20 |
| 192,674 | * | 7/1877 | Brumby | 297/20 |
| 195,545 | * | 9/1877 | Sutherland | 297/32 X |
| 196,689 | * | 10/1877 | McAleer | 297/32 X |
| 213,894 | * | 4/1879 | Graetz | 297/32 X |
| 251,783 | * | 1/1882 | Johnson et al. | 297/20 |
| 297,809 | * | 4/1884 | Jones | 297/20 |
| 307,556 | * | 11/1884 | Ladewig | 297/32 |
| 333,273 | * | 12/1885 | Achenbach | 297/20 |
| 389,572 | * | 9/1888 | Holden et al. | 297/20 |
| 417,819 | * | 12/1889 | Gage | 297/32 X |
| 444,992 | * | 1/1891 | Pohl | 297/20 |
| 457,780 | * | 8/1891 | Jones | 297/32 |
| 622,149 | * | 3/1899 | Holton | 297/20 |
| 676,788 | * | 6/1901 | Wallis | 297/20 |
| 678,376 | * | 7/1901 | Carlson | 297/20 |
| 768,990 | * | 8/1904 | Hoecke | 297/32 X |
| 808,098 | * | 12/1905 | Lewis | 297/20 |
| 870,260 | * | 11/1907 | Thomas | 297/32 X |
| 877,646 | * | 1/1908 | Holloway | 297/20 |
| 912,216 | * | 2/1909 | Wells | 297/32 X |
| 942,724 | * | 12/1909 | Flindall | 297/32 X |
| 1,228,967 | * | 6/1917 | Rho | 297/20 |
| 1,264,309 | * | 4/1918 | Lard | 297/32 |
| 1,711,371 | * | 4/1929 | Zentmyer | 297/32 |
| 4,152,023 | | 5/1979 | Buhk . | |

(List continued on next page.)

OTHER PUBLICATIONS

Folding Tailgate Table, The American Tailgater Company, Mar. 31, 2000, www.americantailgater.com, 2 pages.

EZ Rocker, The American Tailgater Company, Mar. 31, 2000, www.americantailgater.com, 2 pages.

* cited by examiner

*Primary Examiner*—Peter M. Cuomo
*Assistant Examiner*—Rodney B. White
(74) *Attorney, Agent, or Firm*—Marshall, O'Toole, Gerstein, Murray & Borun

(57) ABSTRACT

A portable furniture assembly has a pair of opposed and spaced apart scissor assemblies. A stop mechanism is provided to retain a pair of scissor structures of the portable furniture assembly in a set-up condition and yet permit easy release of the stop mechanism to permit folding of the furniture assembly for transport. A foldable and portable chair has a flexible sling suspended between two scissor assemblies to define a seat and a back for the chair. The portable chair also has two bottom rails connected to front supports of the scissor assemblies via pivots. Rear supports of the scissor assemblies are removably connected to the bottom rails at the stop mechanism to retain the portable chair in a set-up condition and yet permit the chair to be folded to a completely flat or folded condition.

15 Claims, 7 Drawing Sheets

U.S. PATENT DOCUMENTS

| | | | | |
|---|---|---|---|---|
| 1,724,220 | * | 8/1929 | Puccia | 297/32 |
| 1,782,763 | * | 11/1930 | Overbey | 297/32 X |
| 2,543,543 | * | 2/1951 | Gomes et al. | 297/20 |
| 2,708,960 | * | 5/1955 | Shephard | 297/41 X |
| 4,014,591 | | 3/1977 | Gittings | 297/55 |
| 4,077,668 | | 3/1978 | Puccinelli | 297/18 X |
| 4,118,064 | | 10/1978 | Robeson | 297/18 |
| 4,192,547 | * | 3/1980 | Geier | 297/271.5 X |
| 4,241,950 | | 12/1980 | Simpson | 297/56 X |
| 4,251,106 | | 2/1981 | Gilbert | 297/18 |
| 4,298,227 | | 11/1981 | Berthier et al. | 297/58 |
| 4,685,725 | | 8/1987 | Helfrich | 297/45 |
| 4,715,650 | | 12/1987 | Berman et al. | 297/28 |
| 4,925,239 | | 5/1990 | Powers | 297/17 X |
| 5,054,849 | | 10/1991 | Hoff | 297/45 |
| 5,098,154 | | 3/1992 | Emery . | |
| 5,253,921 | | 10/1993 | Boulet | 297/32 |
| 5,499,857 | | 3/1996 | Lynch, Jr. | 297/16.2 |
| 5,560,675 | | 10/1996 | Altheimer et al. | 297/32 X |
| 5,718,473 | | 2/1998 | Lynch, Jr. | 297/16.2 |
| 5,839,781 | * | 11/1998 | Knape | 297/258.1 |
| 5,897,161 | | 4/1999 | Karg | 297/16.2 |
| 5,911,469 | | 6/1999 | Young | 297/31 |
| 5,915,782 | | 6/1999 | Geldbaugh | 297/16.2 |

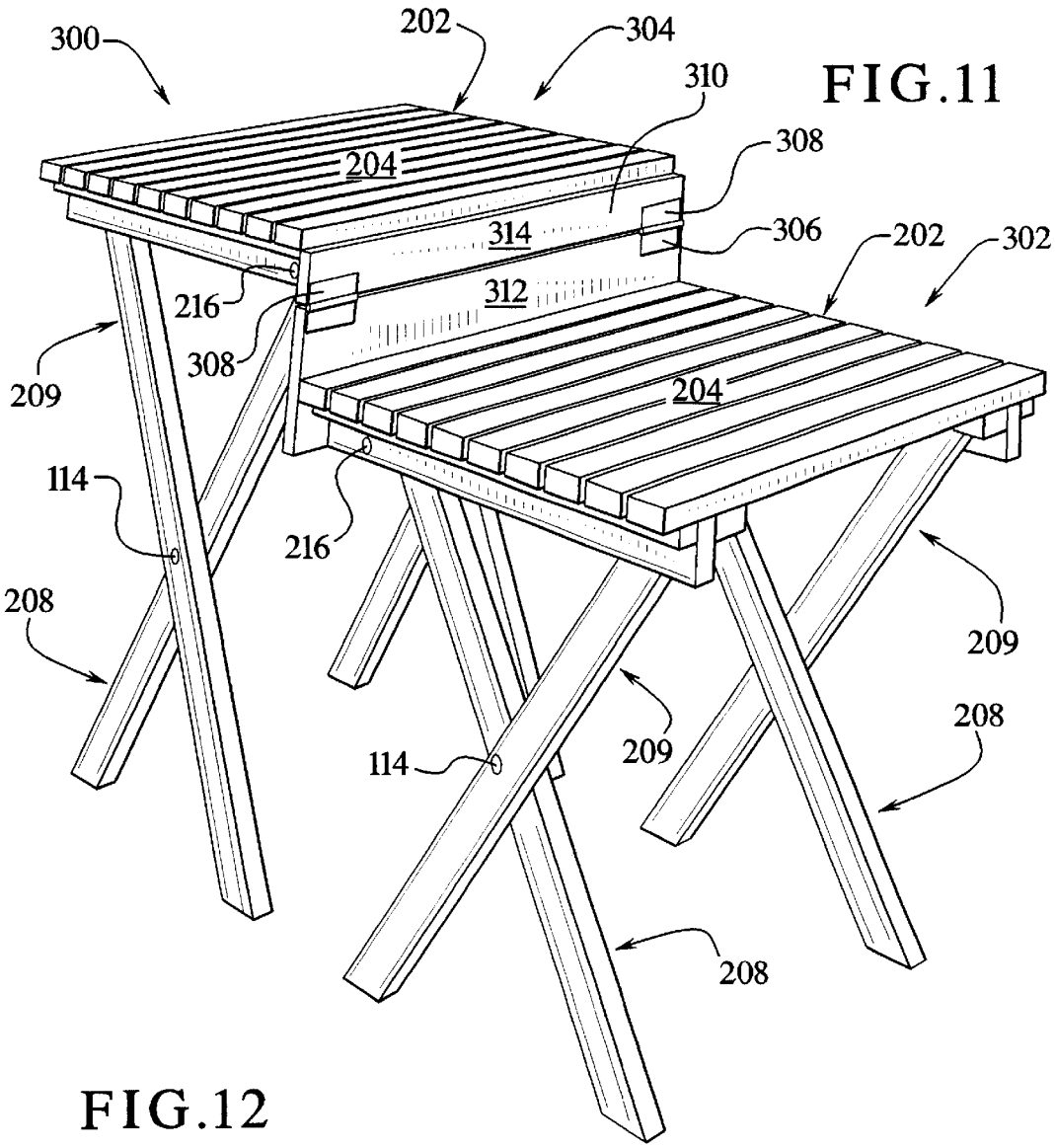
FIG.11
FIG.12
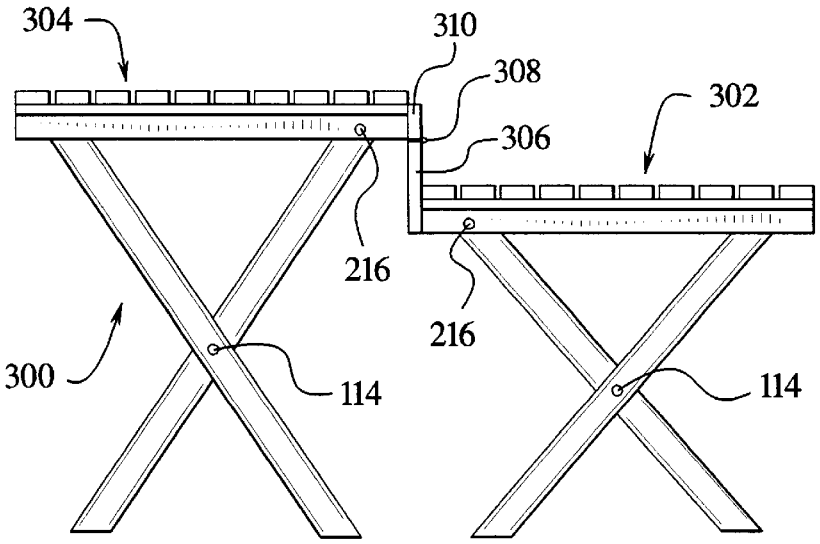

FIG.13
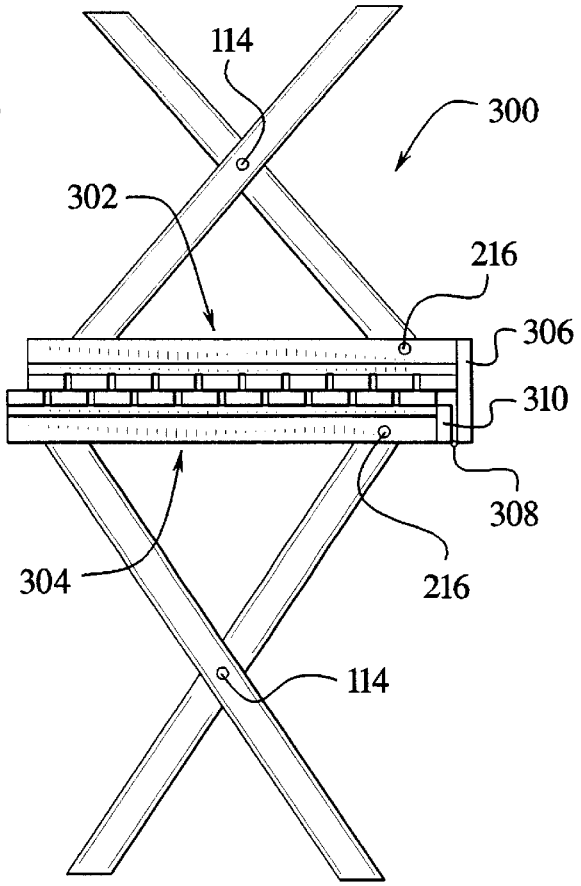
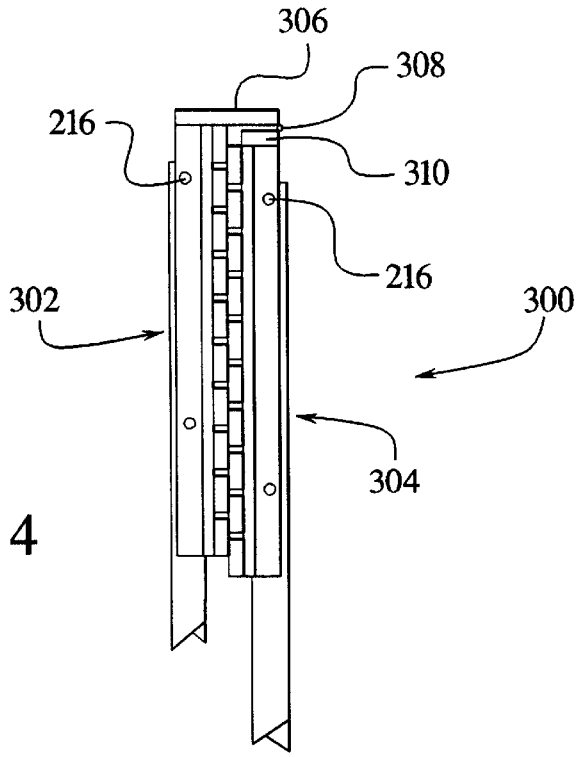
FIG.14

FOLDABLE AND PORTABLE FURNITURE ASSEMBLY

BACKGROUND OF THE INVENTION

1. Field of the Invention

The present invention relates generally to portable folding furniture, and more particularly to a furniture piece that can be collapsed to a folded condition rendering the structure portable and un-folded to a set-up condition providing a sturdy piece of furniture.

2. Description of the Related Art

Portable folding chairs and tables are known in the art and are provided in many different forms and manufactured from many different materials. Folding metal chairs are known that have a tubular frame with front legs that extend upward and rearward wherein a metal sheet is attached to the upper ends of the legs defining a backrest. The rear legs of the chair typically extend upward and forward and attach to the front legs in scissor-like fashion at a leg pivot. The rear legs connect to a separate seat structure also typically in the form of a formed metal sheet. These types of chairs have a thin metal bar interconnecting the front and rear leg on each side of the chair below the leg pivot. The thin bar also has an intermediate pivot so that the bar can be bent in half when the chair is folded together. Folding and unfolding of the chair requires first manually lifting on the pivot of the thin bar.

There are many other types of folding chairs known in the art. The majority of these constructions are relatively complex and include a number of separate components to complete the chair and to support the chair in a set-up condition. There are also conventional folding table constructions which have four legs and a table top. Each leg folds down from being parallel with one edge of the tabletop to being perpendicular to the table top. These types of folding tables are commonly known as card tables.

Folding sling chairs are also known in the art and utilize a number of structural components which can be folded and unfolded to construct a piece of furniture or make the furniture portable. These types of chairs utilize a piece of fabric suspended by its two opposite ends. The single piece of fabric forms both a chair seat and chair backrest when a person sits in the chair with their weight supported by the fabric sling. Examples of sling chairs are disclosed in U.S. Pat. Nos. 5,718,473 and 5,054,849.

Folding rocking chairs are also known in the art and also typically include a multitude of separate components that form the chair assembly. Foldable rocking chairs sometimes include bottom rails that have curved bottom surfaces on which an individual can rock. An example of such a folding rocking chair is disclosed in U.S. Pat. No. 5,560,675. An even more elaborate foldable rocking chair construction is disclosed in U.S. Pat. No. 5,253,921 and includes a number of sliding and pivoting elements interconnected to one another. The bottom rails sit on the ground and remain stationary while other elements of the chair produce the rocking feature.

SUMMARY OF THE INVENTION

What is needed is an inexpensive, sturdy and compact folding furniture piece that can be taken along when traveling and utilized just about anywhere. What is also needed is a furniture piece that is lightweight, easy to assemble, simple to manufacture, and requires a minimum number of moving parts and yet provides a sturdy construction.

The present invention is directed to a portable furniture assembly such as a chair or a table that utilizes a scissor construction that is foldable and yet provides a very sturdy, stable piece of furniture. In one embodiment of the invention, a portable chair is movable between at least a folded condition and a set-up condition. The portable chair has two spaced apart and opposed bottom rails each having a bottom surface, a forward end and a rear end. The portable chair also has two spaced apart and opposed leg scissors. Each leg scissor has a long support and a short support that intersect one another and are pivotally attached to one another at a leg pivot. The long support of each leg scissor defines a front leg section below the leg pivot and terminates at a bottom end. Each long support also defines a seat back section above the leg pivot and terminates at a top end. The short support of each leg scissor defines a rear leg section below the leg pivot that terminates at a lower end and a seat front support above the leg pivot that terminates at an upper end. The portable chair also has a backrest link interconnecting the seat back sections of the long supports, a seat rest link interconnecting the seat front sections of the short supports, and a rail link interconnecting the bottom rails near the rear ends. A front leg joint pivotally connects the bottom ends of each front leg section to a corresponding bottom rail near the forward end. A flexible sling is suspended at its opposite ends and defines both the chair seat and chair backrest. The lower ends of the short supports are held fixed by a stop mechanism when the chair is in the set-up condition.

In one embodiment, the backrest link and the two long supports are each a discrete separate structure with the backrest link connected to the two long supports. In another embodiment, the backrest link and the two long supports are integrally formed as a single unitary structure.

In one embodiment, the seat rest link and the two short supports are each a discrete separate structure with the seat rest link connected to the two short supports. In another embodiment, the seat rest link and the two short supports are integrally formed as a single unitary structure.

In one embodiment, the rail link and the two bottom rails are each a discrete separate structure with the rail link connected to the two bottom rails. In another embodiment, the rail link and the two bottom rails are integrally formed as a single unitary structure.

In one embodiment, the bottom surfaces of the bottom rails are arcuate and define a rocking surface thereby forming a rocking portable chair.

In one embodiment, each of the links and supports are molded from a thermoplastic material. In another embodiment, each of the links and supports are fabricated from wood.

In one embodiment, the flexible sling is a fabric sling with one end suspended from the backrest link and the other end suspended from the seat rest link.

In one embodiment, the stop mechanism is provided by both the rail link and the lower ends of the short supports wherein the lower ends have a contoured notch formed thereon that corresponds to and abuts against the rail link when the chair is in the set-up condition.

In another embodiment of the invention, a portable table is movable between at least a folded condition and a set-up condition. The portable table has a tabletop with a top surface and a bottom surface. The portable table also has two opposed and spaced apart leg scissors that depend generally from below the bottom surface of the tabletop. Each of the leg scissors has two elongate supports that intersect one another and are pivotally attached to one another at a leg pivot. Each of the leg scissors defines two lower leg sections wherein one lower leg section of each scissor is defined below the leg pivot on each elongate support. Each of the elongate supports of the leg scissors also defines an upper support section that terminates at a top end. One upper support section of each leg scissor is defined above the leg pivot on each elongate support. The portable table has at least one tabletop joint that pivotally connects the top ends of two corresponding of the upper support sections to the tabletop, one on each leg scissor. At least one stop mechanism is provided that fixes the top end of each of the other two opposed upper support sections to the tabletop when the table is in the set-up condition.

In another embodiment of the invention, a portable table is provided that has two separate top surfaces at different height levels. The table includes two separate portable table sections, each similar to the table described above. A first section has a lower surface provided by a tabletop carried on a first pair of leg scissors each defined by first elongate supports. A second section has a higher surface provided by a tabletop carried on a second pair of leg scissors having second elongate supports that are longer than the first elongate supports. The back edges of the two tabletops are interconnected by an interconnecting panel with a first piece of the interconnecting panel affixed to the back edge of the first tabletop and a second piece of the interconnecting panel affixed to the second tabletop. The two pieces of the interconnecting panel are hingedly attached to one another. The lower first tabletop can be pivoted about the hinges so that its top surface abuts the top surface of the second tabletop. The leg scissors of the two sections can then be folded generally parallel to one another.

These and other objects, features and advantages of the present invention will become apparent upon a review of the written description and the corresponding drawing figures. The exemplary embodiments of the present invention described and shown herein are provided in order to illustrate and not to limit the permissible scope of the present invention. Changes and modifications can be made to the embodiments described herein and yet fall within the scope of the present invention.

BRIEF DESCRIPTION OF THE DRAWINGS

The following drawing figures represent a number of permissible embodiments of the present invention. Like reference numerals provided in the drawings represent like components in each embodiment of the invention and, wherein:

FIG. 11 illustrates a perspective view of a portable table constructed in accordance with another embodiment of the present invention;

FIG. 12 a side view of the portable table of FIG. 11;

FIG. 13 illustrates a side view of the portable table of FIGS. 11 and 12 in a partially folded condition; and FIG. 14 illustrates the portable table of FIGS. 11–13 in a completely folded condition.

DETAILED DESCRIPTION OF THE PREFERRED EMBODIMENTS

Figure 1:
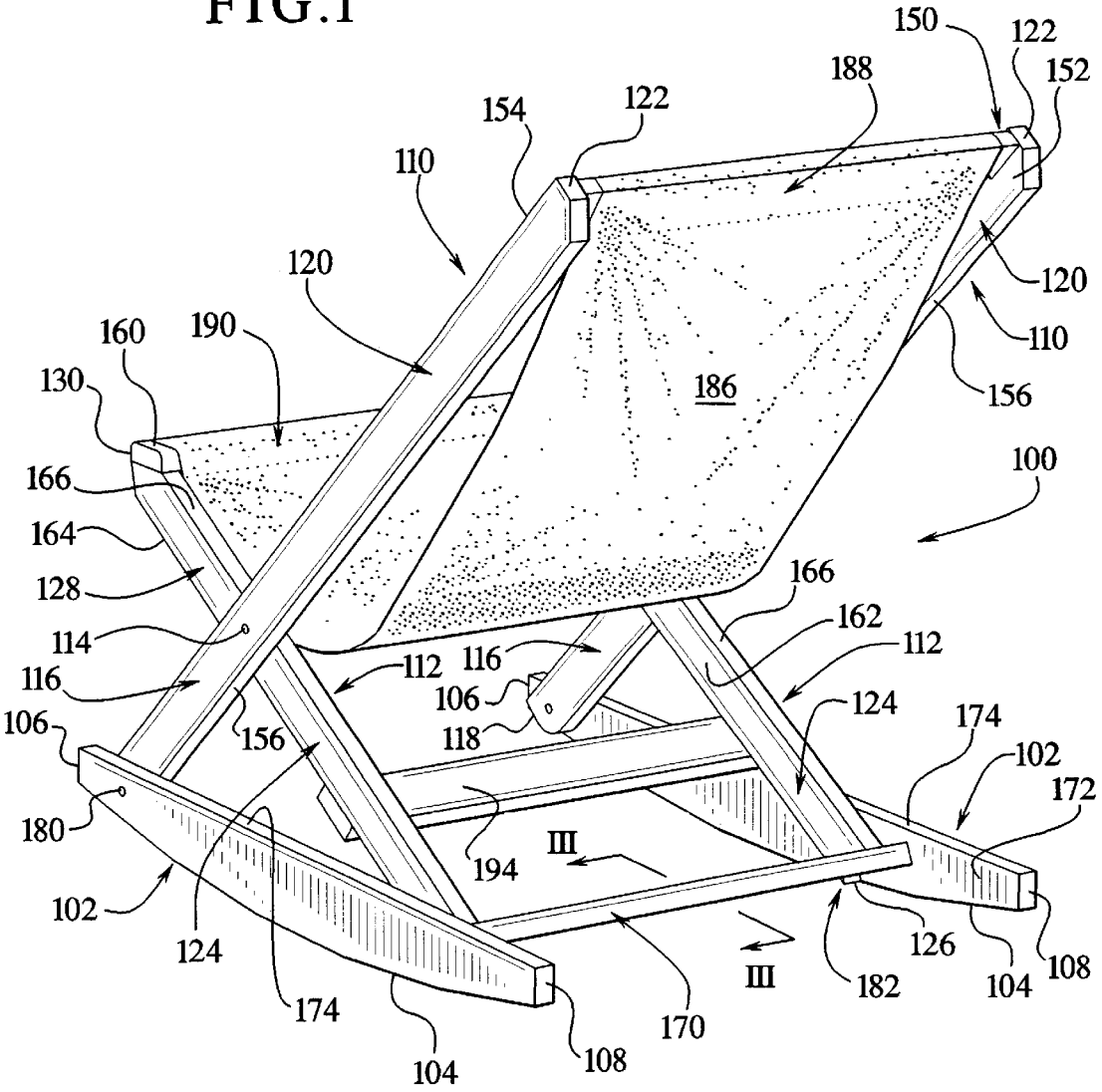
FIG. 1 illustrates a rear perspective view of a portable chair in a set-up condition and constructed in accordance with one embodiment of the present invention.
Figure 7:
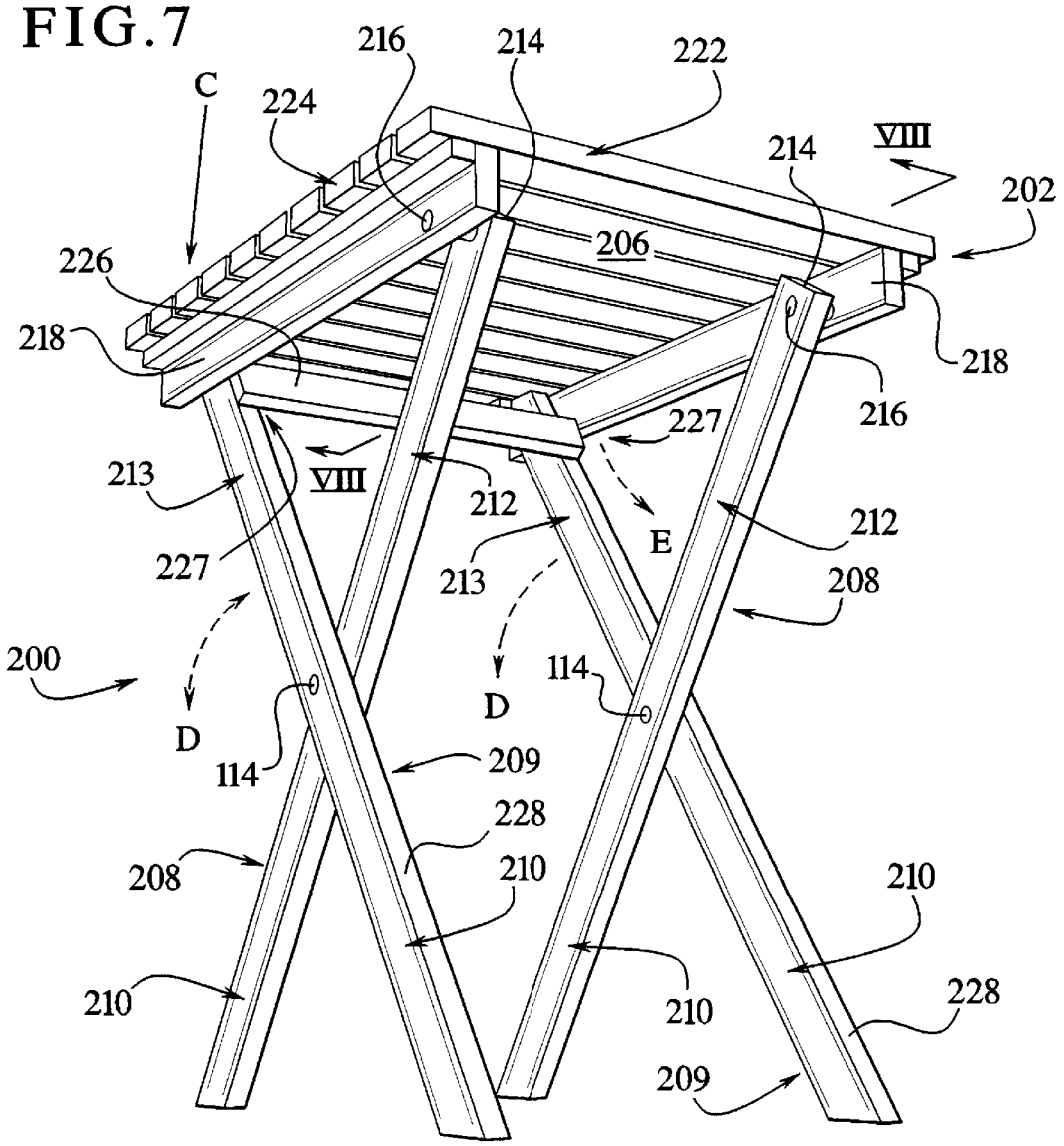
FIG. 7 illustrates a perspective view of a portable table in a set-up condition and constructed in accordance with another embodiment of the present invention.

The present invention is generally directed to a foldable furniture structure such as a portable chair or a portable table, respectively illustrated in FIGS. 1 and 7. The concept of the present invention is to provide a very sturdy and yet simple construction for a foldable piece of furniture that can be easily broken down and set up and can also be easily transported in its folded condition. The present invention provides for a simple interlock between two portions of the furniture structure in order to create the sturdy construction and permit simple folding of the furniture.

Figure 2:
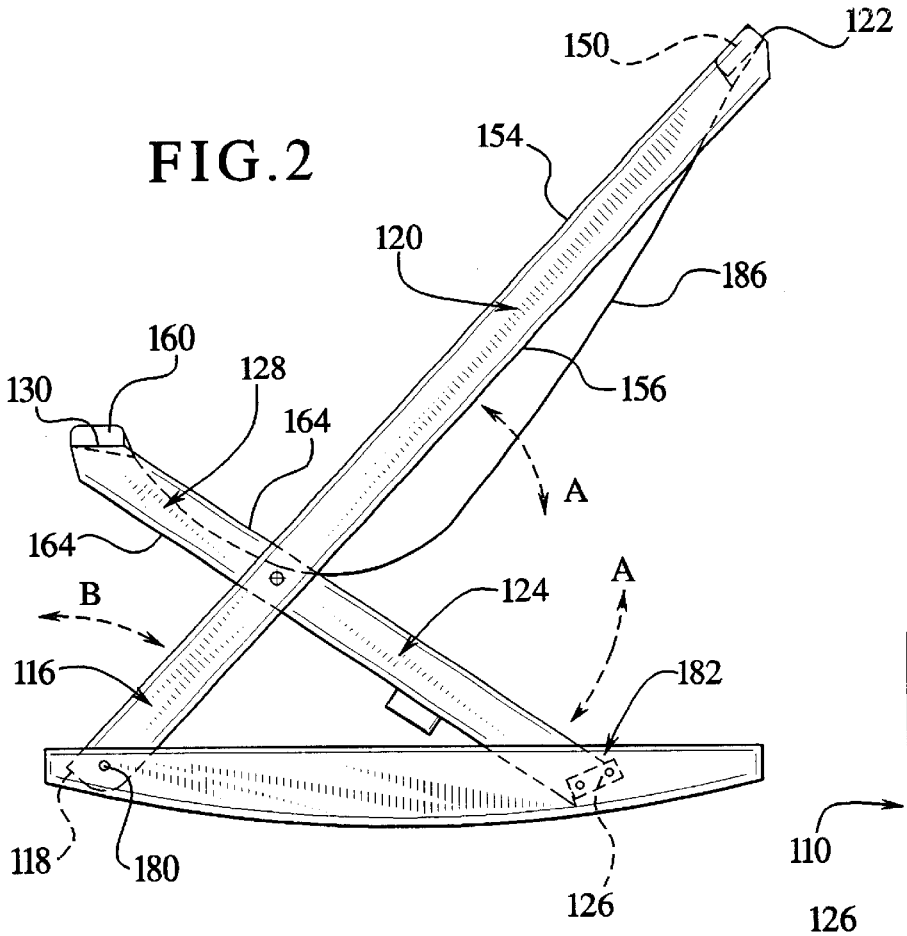
FIG. 2 illustrates a side view of the portable chair of FIG. 1.

Referring now to FIGS. 1–6, a portable chair is illustrated and is constructed in accordance with at least two embodiments of the present invention. FIGS. 1 and 2 illustrate a portable chair 100 shown in a set-up condition. The portable chair 100 is movable between at least a completely folded condition illustrated in FIGS. 4 and 5 and the set-up condition.

The portable chair 100 has two spaced apart and opposed bottom rails 102 each having a bottom surface 104, a forward end 106 and a rear end 108. The portable chair 100 also has a pair of spaced apart and opposed leg scissor assemblies wherein each leg scissor assembly has an intersecting long support 110 and a short support 112. The long support 110 and short support 112 are pivotally attached to one another at a leg pivot 114 of each leg scissor assembly. The leg pivot 114 permits the long support 110 and short support 112 to rotate relative to one another about the leg pivot. The long support 110 of each leg scissor assembly defines a front leg section 116 below the leg pivot 114. Each front leg section 116 terminates at a bottom end 118 of each long support 110. The long support 110 of each leg scissor assembly also defines a seat back section 120 above the leg pivot 114. Each seat back section 120 terminates at a top end 122 of the long support 110.

The short support 112 of each leg scissor assembly defines a rear leg section 124 below the leg pivot 114. Each rear leg section 124 terminates at a lower end 126 of the short supports. The short support 112 of each leg scissor assembly also defines a seat front support 128 above the leg pivot 114. Each of the seat front supports 128 terminates at an upper end 130 of the short supports.

The bottom ends 118 of the front leg sections 116 and the lower ends 126 of the rear leg sections 124 rest on a ground or support surface when the portable chair 100 is in use in he set-up condition.

The portable chair 100 also has a backrest link or cross member 150 that interconnects the seat back sections 120 of the long supports 110. In one embodiment, the backrest link 150 is disposed between the seat back sections 120 and abuts at its opposite ends against inside surfaces 152 of the seat back sections. The location of the backrest link can vary without departing from the scope of the present invention but in the present embodiment is illustrated adjacent the top ends 122 of the long supports 110. The seat back link 150 can alternatively be disposed somewhere between the top ends 122 and the leg pivot 114 and fall within the scope of the invention. More than one backrest link 150 can also be utilized. Though the backrest link 150 in the present embodiment is illustrated as being perpendicular to the seat back sections 120, the backrest link or links 150 can alternatively be disposed at angles that are not normal or perpendicular to the seat back sections 120. The backrest link or links 150 can also be curved, although the link 150 is shown as a linear cross member in the present embodiment. The backrest link 150 can alternatively be adhered to front surfaces 154, or to back surfaces 156 of the seat back sections 120 and fall within the scope of the present invention. In another alternative construction, the backrest link 150 can be connected directly on top and abutting against the top ends 122 of the long supports 110.

The portable chair 100 also incorporates a seat rest link or cross member 160 that interconnects the seat front sections 128 of the short supports 112. Again, the number, orientation, shape, and attachment of the seat rest link 160 can vary considerably without departing from the scope and spirit of the present invention. For example, the seat rest link 160 can be attached and abut directly to the upper ends 130 of the short supports 112 as illustrated or can alternatively attach to inside surfaces 162, front surfaces 164 or back surfaces 166 of the short supports 112 if desired.

The portable chair 100 also includes a rail link or cross member 170 that interconnects inside surfaces 172 of the bottom rails 102 near the rear ends 108. Again, the bottom rails 102 can be interconnected by more than one rail link 170. Additionally, the rail link 170 can be connected to top surfaces 174, or bottom surfaces 104, without departing from the spirit and scope of the invention. The rail link or links 170 can also vary in shape.

The portable chair 100 also includes a front leg joint 180 that pivotally connects each front leg section 116 of the long supports 110 near the bottom ends 118 to a corresponding one of the bottom rails 102 near the respective forward ends 106. The front leg joints 180 permit rotational movement about the joints between the bottom rails 102 and the long supports 110.

Figure 3:
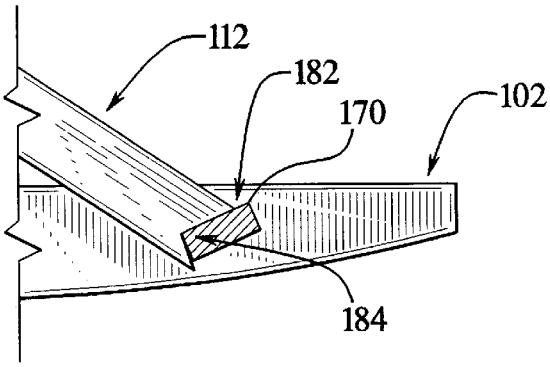
FIG. 3 illustrates a fragmentary partial sectional view taken along line III—III of FIG. 1.

As shown in FIG. 3, the portable chair 100 also includes at least one stop mechanism 182. In the present embodiment, the lower ends 126 of the short supports 112 abut against the rail link 170 when the portable chair 100 is in the set-up condition. The stop mechanism 182 of this embodiment is formed by the rail link 170 and lower end 126 of each short support 112. The one or more stop mechanisms 182 can take on any number of configurations and constructions without departing from the spirit and scope of the invention. In the present embodiment, the rail link 170 serves as a stop surface against which the lower ends 126 of the short supports 112 rest. In this embodiment, the lower ends 126 include a notched cutout 184 with a contour that corresponds to the shape of the rail link 170. The notch or cutout 184 in the lower ends 126 combines with the rail link 170 to form each stop mechanism 182.

Alternatively, separate additional elements can be added to either the bottom rails 102 or to the rear leg sections 124 in order to form a part of the stop mechanism 182. In another alternative, integral protrusions or cutouts can be provided on the bottom rails, the rear leg sections, or both to form an appropriate stop mechanism that will releasably but securely hold the rear leg sections 124 in a fixed position when the chair is in the set-up condition.

The portable chair 100 also includes a flexible sling 186 in the form of a sheet of flexible material. The flexible sling 186 is suspended in an appropriate manner from its opposite ends 188 and 190 between the seat back sections 120 of the long supports 110 near the top ends 122 and the seat front sections 128 of the short supports 112 near the upper ends 130. The suspended sheet of material 186 defines both a seat cushion and a seat back of the portable chair 100.

The flexible sling 186 can be formed from virtually any suitable material such as a cloth or fabric material or a durable and flexible rubber or plastic composition. The flexible sling 186 is intended to hang somewhat loosely between its opposed ends 188 and 190 so that a person can sit in the chair 100 comfortably and be fully supported by the material.

In the embodiment illustrated in FIGS. 1–6, the flexible sling 186 is connected to and suspended from the backrest link 150 and the seat rest link 160 by the opposed ends 188 and 190, respectively. In one embodiment the flexible sling 186, such as a cloth or fabric material is wrapped at least once around the links 150 and 160 and fastened or adhered thereto by a suitable adhesive or fastener such as a number of staples. In an alternative embodiment shown in FIG. 6, the flexible sling 186 can include a loop 192 of the sling material formed on each of the opposed ends 188 and 190 through which the links 150 and 160 are received prior to assembly of the chair 100. In another alternative embodiment, the ends 188 and 190 of the flexible sling 186 can be adhered or otherwise fastened to a portion of the supports 110 and 112 or to the links 150 and 160 by discrete elements such as rope, string, hog rings or the like. The manner in which the flexible sling 186 is adhered to the chair 100 can vary considerably within the scope of the present invention.

In use, the portable chair 100 can be manipulated by pivoting the long and short supports 110 and 112 about the leg pivots 114 in the direction of the arrows "A". The long supports are pivoted about the front leg joints 180 relative to the bottom rails 102 in the direction of the arrows "B". FIGS. 1 and 2 illustrate the portable chair 100 in a set-up condition wherein the chair is manipulated so that a user can sit on the chair. In this condition, the notched cutouts 184 abut against the rail link 170 and rest thereon. When an individual sits in the chair, their weight pressed downward and forces the rear leg sections rearward away from the front leg sections 116 since the front leg sections are fixed by the front leg joints 180. The notched cut out 184 and the rail link 170 are contoured and oriented such that the rearward movement of the rear leg sections is prevented and the two components lock together. In this manner, the chair provides a sturdy, rigid construction that can support the weight of a user and the user's weight increases the rigidity of the chair. The stop mechanisms 182 in any embodiment preferably use the weight of the user to force the stop mechanism components together, increasing the chair's rigidity.

Figure 5:
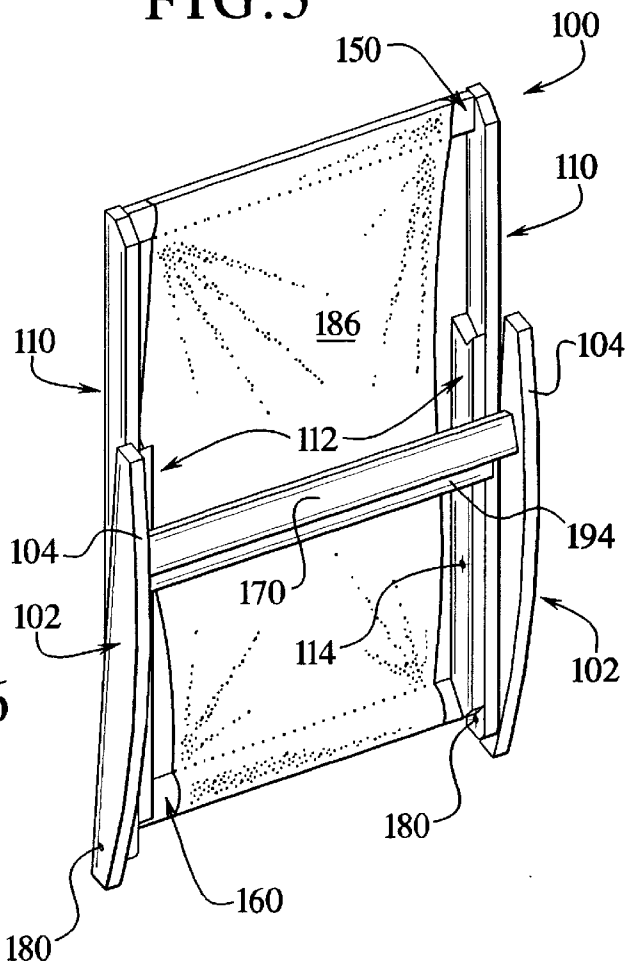
FIG. 5 illustrates a perspective view of the portable chair of FIG. 1 in a completely folded condition.
Figure 6:
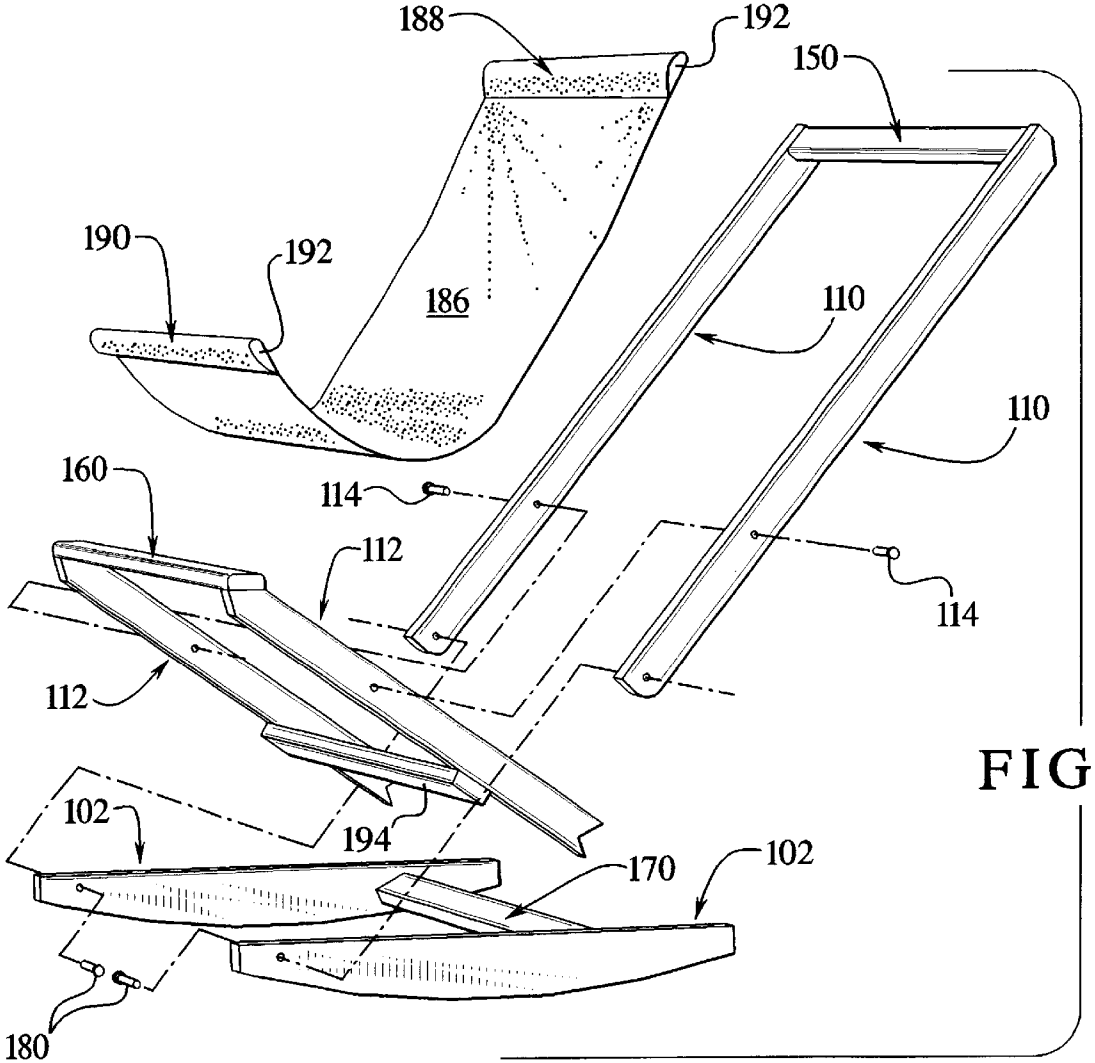
FIG. 6 illustrates an exploded view of a portable chair constructed in accordance with another embodiment of the present invention.

The backrest link 150, seat rest link 160, and rail link 170 also provide lateral structural rigidity to the chair 100. It will be evident to those skilled in the art that other structural members such as additional cross members or links can be added between the supports or the links to increase the rigidity of the chair, if so desired. As shown in FIGS. 1, 5 and 6, a cross-member 194 extends between and interconnects the two rear legs 124 providing additional rigidity to the chair structure.

In the embodiment illustrated in FIG. 1, the long supports, the short supports, the backrest link, the seat rest link, and the rail link are all separate discrete structural elements that are affixed to one another by a suitable manner. The components can be fastened together utilizing nails, screws, nuts and bolts, staples, adhesives, hook and loop fasteners, dowels, tongue and groove formations, or other such suitable fastening mechanisms. Combinations of the above fastening methods can also be used.

In another embodiment, such as the embodiment illustrated in FIG. 6, one or more of the components of the chair 100 can be formed as integral unitary structural components. For example, the two long supports 110 and the backrest link 150 can be integrally formed as a single unitary U-shaped structure. The two short supports 112 and the seat rest link 160 can also be formed as an integral unitary structure. The cross-member 194 can also be formed as a part of this unit. Also, the two bottom rails 102 and the rail link 170 can be formed as a unitary integral structure. Regardless of whether the components of the chair are formed integrally or as discrete separate components, the chair is easily assembled as illustrated in FIG. 6.

The leg pivots 114 and the pivot joints 180 can also vary considerably without departing from the spirit and scope of the invention. The pivots can be loosely mounted fasteners including washers, nuts and bolts or can comprise steel, plastic, nylon or Teflon® elements forming pivot shafts and bearings. The shafts can be secured in any suitable manner, utilizing nuts, cotter, pins, rivets, machine or rolled flanges, or the like. It is imperative that the leg pivots 114 and front leg joints 180 permit relative ease of rotation between the components and yet remain securely fastened.

In the embodiments illustrated in FIGS. 1–6, the bottom surface 104 of the bottom rails 102 is a curved surface. The portable chair 100 is thereby a rocking chair providing an additional feature without adding any additional parts to the structure. The bottom surfaces 104 of the rails 102 can also be straight, linear surfaces that rest securely on the ground. Such an embodiment would not provide a rocking chair feature.

The components of the chair 100 can vary in shape, size and material structure without departing from the spirit and scope of the invention. The size of the individual components including the length will determine the size and shape of the chair. It is conceivable that the bottom rails can be exceptionally long and that the long supports 1 10 and short supports 112 can be of the same length. Such a construction will define a flexible sling cot or hammock. Such alternative constructions are within the purview of the present invention.

Figure 4:
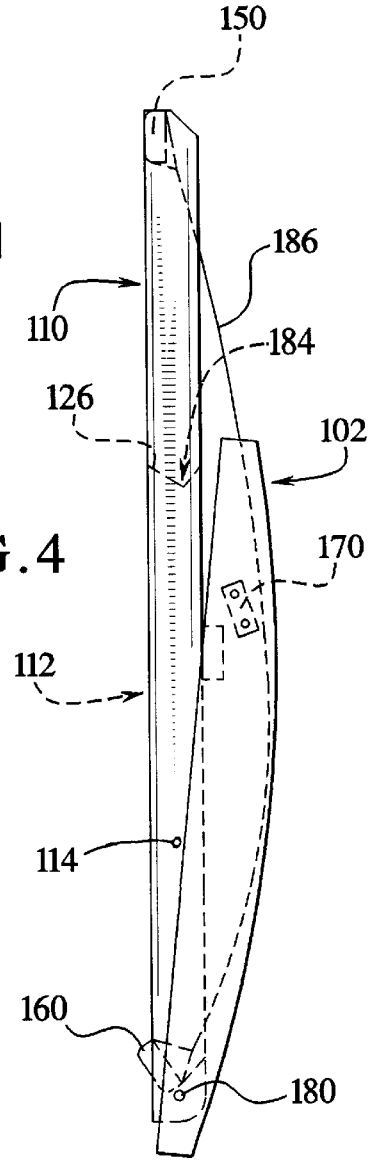
FIG. 4 illustrates a side view of the portable chair of FIG. 1 in a completely folded condition.

FIGS. 4 and 5 illustrates the portable chair 100 in a completely folded condition. The long supports 110 and the short supports 112 are pivoted about the leg pivots 1 14 so that they are generally parallel to one another. The rear leg sections 124 are preferably pivoted toward the seat back supports 120. The bottom rails 102 are pivoted about the pivot joints 180 generally parallel with the long and short supports. However, depending on the positioning of the rail link 170, folding the bottom rails 102 to a completely parallel position may not be possible because the positioning of the rail link may prevent the long and short supports from being received completely between the bottom rails. Positioning of the pivot joints 180 and design shape of the supports and links can easily accommodate a completely parallel folded chair.

In the present embodiment, the short supports 112 are received between and on the inside surfaces 152 of the long supports 110 and can therefore pivot to be completely parallel to and between the long supports. The long supports 110 can be positioned either on the inside surfaces 174 or the outside surfaces of the bottom rails 102. Further, the short supports 112 can be positioned on outside surfaces 196 of the long supports 110 and yet fall within the purview of the present invention. These alternative constructions of the portable chair 100 will necessitate alternative stop mechanism design and placement in order to prevent the rear leg sections 124 from being displaced when the chair is in a set-up condition as described above.

Figure 8:
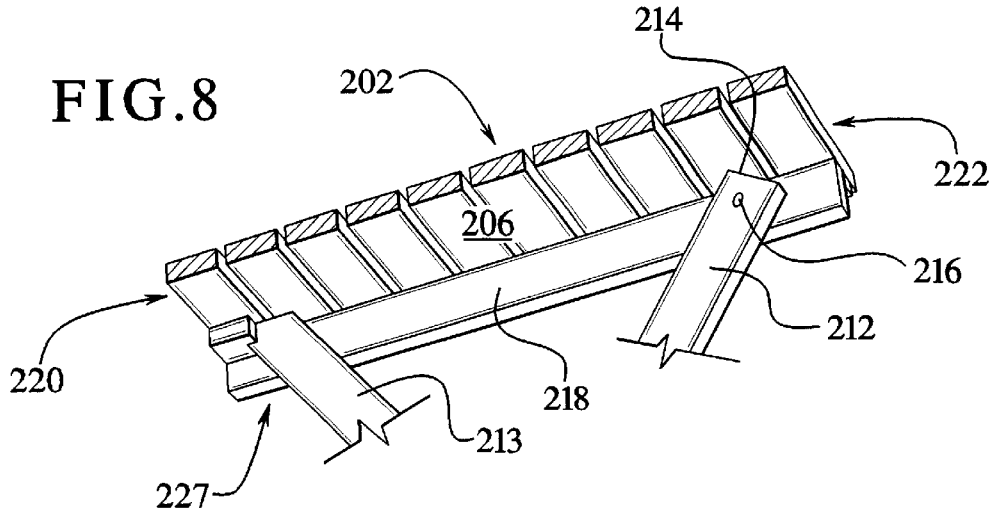
FIG. 8 illustrates a partial fragmentary sectional view taken along line VIII—VIII of FIG. 7 showing a portion of the table in a set-up condition.
Figure 9:
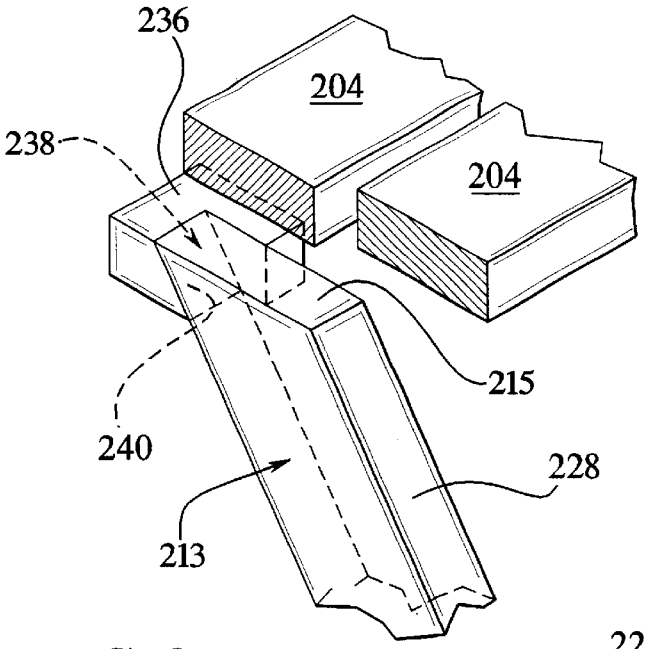
FIG. 9 illustrates a partial fragmentary sectional view of an alternative construction of the portable table of FIG. 7.
Figure 10:
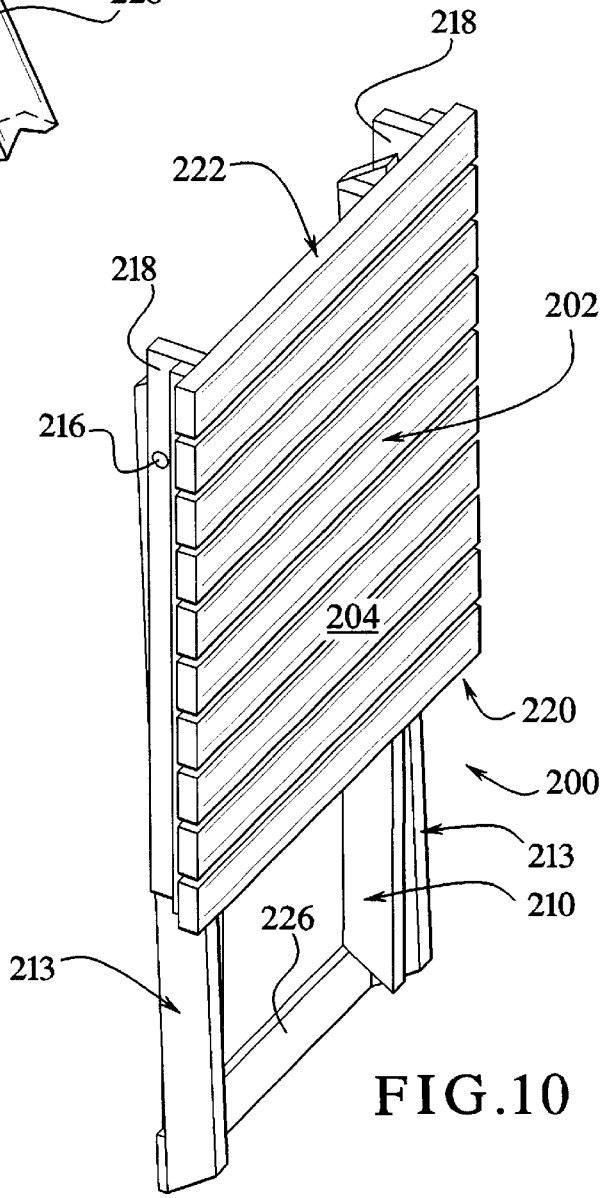
FIG. 10 illustrates the portable table of FIG. 7 in a completely folded condition.

Referring now to FIGS. 7–10, a portable table 200 is illustrated and is movable between at least a folded condition, shown in FIG. 10, and a set-up condition, shown in FIG. 7, similar to the portable chair 100 described above. The portable table 200 has a tabletop 202 with a top surface 204 and a bottom surface 206. The portable table 200 also has two opposed and spaced apart leg scissor assemblies that depend generally from below the bottom surface 204. Each leg scissor assembly has a pair of elongate supports 208, 209 that are of essentially the same length. The elongate supports 208 and 209 are similar in construction and function to the long and short supports 110 and 112 described above for the portable chair. The supports 208 and 209 of each leg scissor assembly intersect one another and are pivotally connected to one another by a leg pivot 114 which is essentially identical to that described above for the chair. Four lower leg sections 210 are defined, one each below the leg pivot 114 on each of the elongate supports 208 and 209. The elongate supports 208 define two opposed end pivoting upper support sections 212 above the leg pivots 114 that each terminate at a top end 214. The elongate supports 209 define two opposed and free upper supports 213 above the leg pivots 114 that each terminate at a top end 215.

A tabletop joint 216 connects the two opposed and pivoting upper support sections 212 near the top ends 214, one on each scissor assembly, to the tabletop. In the embodiment illustrated in FIGS. 7 and 8, the two tabletop joints 216 are carried, each on one of a pair of cross members 218 attached to the bottom surface 204 of the tabletop. The cross members 218 in this embodiment extend from a front edge 220 to a back edge 222 of the tabletop, herein termed as such for convenience of description only. The tabletop joints 216 can alternatively be connected directly into opposed side edges 224 of the tabletop or into opposed ends of an alternative transverse cross member (not shown) attached to the bottom surface 204 of the tabletop and extending between the side edges 224, or perpendicular to the orientation of the cross members 218 illustrated in FIGS. 7 and 8.

The table 200 also has an optional structural link 226 that interconnects the other two opposed upper support sections 213 adjacent their top ends 215 to add structural rigidity to the leg scissor assemblies. It is apparent that the link 226 is not necessary to provide a table according to the present invention. More than one structural link having any number of orientations and positions can be provided to increase the structural rigidity and stiffness of the table 200.

The table 200 also has at least one stop mechanism 227 that fixes the tabletop to the top end 215 of the other two opposed and free upper support sections 213. The table 200 is similar in construction to the chair 100 in that the free opposed upper support sections 213 are prevented from moving laterally away from the fixed upper support sections 212 when the table is in the set-up condition as illustrated in FIG. 4. When items are placed on the top surface 204 of the tabletop 202, the weight forces the stop mechanism 227 to securely hold the table in the set-up condition.

FIGS. 7 and 8 illustrate one embodiment of the stop mechanism 227 for the table 200.

In this embodiment, the link 226 is connected to a back surface 228 of the supports 209 on the two free upper support sections 213. A pair of stop blocks 230 are disposed on the bottom surface 204 of the tabletop adjacent the front edge 220 but spaced inward from the structural cross members 218. A gap 231 is defined between each stop block 230 and the respective cross member 218. Each gap has a distance that is only slightly larger than the width or thickness of the upper support sections 213. In this embodiment, the top ends 215 of the upper support sections 213 slide into the gaps 231 between the stop blocks 230 and the cross members 218 until the link 226 abuts against a stop surface 232 on each of the stop blocks 230. The angle of the stop surface 232 in the present embodiment preferably corresponds to the angle of the link 226 against which it abuts. In this embodiment, the stop blocks 230 and the structural link 226 in combination define a pair of stop mechanisms 227.

In an alternative embodiment, a continuous cross member or stop block (not shown) can replace the stop blocks 230 and extend across the front edge 220 of the bottom surface 204 of the tabletop 202 and terminate short of the cross members 218, leaving gaps 231 between ends of the single stop block and the cross members. The continuous stop block defines a continuous stop surface that extends between the two cross members 218. In either embodiment, the arrangement can be configured so that the top ends 215 of the free upper support sections 213 align with the front edge 220 of the tabletop for a clean, aesthetically pleasing structure.

FIG. 9 illustrates another alternative embodiment of a stop mechanism, as viewed in the direction of the arrow "C", for the table 200 of the present invention. In this embodiment, two L-shaped stop blocks 236 are provided on the bottom surface 206 near the front edge 220 of the tabletop 202. The L-shaped stop blocks 236 define slots 238 into which the free upper support sections 213 are received. The end surface 240 of each slot 238 provides the stop surface against which the free upper support sections 213 abut when the table is in the set-up condition.

As with the chair construction described above, the stop mechanism 227 can vary considerably without departing from the spirit and scope of the present invention. The free upper support sections 213 can incorporate a separate or an integral element defining a portion of the stop mechanism. The top ends 215 of the free upper support sections can also be varied and provided with a contour that mates with a corresponding element such as a cutout or protrusion provided either on the bottom surface 204 of the tabletop or on one or more structural cross members. The stop mechanism 227 must again prevent the upper support sections 213 of each leg scissor from moving away from the upper support sections 212 when weight is placed on the tabletop. The force instead increases the strength of the interlock at each stop mechanism.

As with the chair construction, the materials, sizes and shapes of the various components of the table 200 can vary considerably without departing from the spirit and scope of the invention. Aesthetically pleasing designs can be provided that will still provide a portable table that can be easily broken down and folded for transport. The elongate supports 208 and 209 can be pivoted relative to one another about the leg pivots 114 in the direction of the arrows "D". The tabletop can be pivoted relative to the supports 208 about the pivot joints 216 in the direction of the arrows "E".

FIG. 10 illustrates the table 200 in a completely folded condition. The elongate supports 208 and 209 of each scissor assembly are pivoted about the leg pivot 114 and folded generally parallel to one another with the free upper support sections 213 pivoted toward the lower legs 210 of the supports 208. The tabletop 202 is then folded about the pivot joints 216 toward the supports 208 and 209 to be generally parallel with the elongate supports.

The table 200 can also be constructed similar to the chair 100 wherein the several components are either provided separately and discretely and then affixed to one another or provided as integrally formed unitary components. Additionally, the table 200 can be varied to incorporate any number of different types of tabletops including the slat construction illustrated in FIGS. 7–14 or a solid planar construction (not shown). The shape of the tabletop 202 can also vary considerably without departing from the spirit and scope of the invention. The materials used to fabricate the components of the table 200 can also vary and include wood, metal, plastics, composites, and the like.

FIG. 11 illustrates a portable table 300 constructed in accordance with another embodiment of the present invention. The portable table 300 essentially includes a pair of portable tables or table sections, each constructed identically to the portable table 200 as described previously. The two portable tables are hingedly connected to one another and provide a bi-level top surface.

A first or short portable table section 302 has a top surface 204 that is disposed lower than a top surface 204 of a second or taller portable table section 304. The shorter table section 302 has a pair of leg scissors each being made of a pair of elongate supports 208 and 209 constructed essentially identical to the elongate supports for the table 200 described previously. The second table section 304 also includes a pair of leg scissors each having a pair of elongate supports 208 and 209 constructed identically to the those of the table 200. The elongate support 208 and 209 of the second table section 304, however, are somewhat longer than the elongate supports of the first table section 302. This is to provide the height difference between the two top surfaces 204 of the table sections 302 and 304.

The stop mechanisms and the folding and unfolding of the table sections 302 and 304 are also essentially identical to that described above for the table 200. However, the two table sections 302 and 304 can also be folded onto one another. In this embodiment, the first or short table section 302 includes a tabletop 202 having a back edge that faces toward the back edge of the tabletop 202 of the second or taller table section 304. A planar wall 306 is affixed to the back edge of the tabletop of the shorter table section 302 and extends upward beyond the top surface 204 of the tabletop 202. One or more hinges 308 are carried at the top edge of the planar wall 306 and are hingedly attached to the back edge of the tabletop 204 of the second or taller table section 304. In the embodiment illustrated in FIGS. 11–14, a separate connection element 310 is attached to the back edge of the tabletop of the second table section 304 wherein the hinge or hinges 308 are carried on the connection element 310. The first and second table sections 302 and 304 can be pivoted relative to one another about the hinges 308 so that the front surfaces 312 and 314 of the wall 306 and the connecting element 310, respectively, confront parallel to one another. The height of the planar wall 306 between the top surface 204 of the tabletop of the first table section 302 and the pivot axis of the hinges 308 are such that the two tabletops 204 of the corresponding table sections 302 and 304 also confront parallel to one another as illustrated in FIG. 13. The height of the planar wall 306 permits the two tabletops to rest flush against one another when the two table sections 302 and 304 are folded relative to one another.

FIGS. 11 and 12 illustrate the table 300 wherein each of the table sections 302 and 304 are unfolded to a set-up condition similar to that described for the table 200. To completely fold the table 300 as illustrated in FIG. 14, the two tabletops 202 of the table sections 302 and 304 are folded to confront one another as illustrated in FIG. 13. The leg scissors are then collapsed as described above for the table 200 for each of the table sections 302 and 304 including the elongate supports are parallel with their respective tabletops. The table 300 as illustrated in FIG. 14 can then be easily transported in its folded condition.

The exemplary embodiments described herein are not intended to limit the present invention. The embodiments are provided herein to illustrate the various aspects of the present invention. The scope and spirit of the present invention is to be limited only by the appended claims.

I claim as my invention:

1. A portable chair moveable between at least a folded condition and a set-up condition, the portable chair comprising:

two spaced apart and opposed bottom rails each having a bottom surface, a forward end, and a rear end;

two spaced apart and opposed leg scissors, each leg scissor including a first support and a second support pivotally attached to one another at a leg pivot, the first support of each leg scissor defining a front leg section below the leg pivot terminating at a bottom end and a seat back section above the leg pivot terminating at a top end, and the second support of each leg scissor defining a rear leg section below the leg pivot terminating at a lower end and a seat front section above the leg pivot terminating at an upper end;

a back rest link interconnecting the seat back sections of the first supports;

a seat rest link interconnecting the seat front sections of the second supports;

a rail link interconnecting the bottom rails near the rear ends;

a front leg joint pivotally connecting each front leg section near the bottom end to the corresponding bottom rail near the forward end;

a flexible sling suspended generally between the first supports and the second supports with one end of the sling disposed near the top ends of the first supports and an opposite end of the sling disposed near the upper ends of the second supports; and a notch formed integrally in the lower end of each rear leg section of each second support, each notch removably bearing directly against and receiving the rail link therein when the chair is in the set-up condition.

2. The portable chair according to claim 1, wherein the back rest link and the two first supports are each a discrete structure and the back rest link is affixed to the two first supports.

3. The portable chair according to claim 1, wherein the back rest link and the two first supports are integrally formed as a single unitary structure.

4. The portable chair according to claim 1, wherein the seat rest link and the two second supports are each a discrete structure and the seat rest link is affixed to the two second supports.

5. The portable chair according to claim 1, wherein the seat rest link and the two second supports are integrally formed as a single unitary structure.

6. The portable chair according to claim 1, wherein the rail link and the two bottom rails are each a discrete structure and the rail link is affixed to the two bottom rails.

7. The portable chair according to claim 1, wherein the rail link and the two bottom rails are integrally formed as a single unitary structure.

8. The portable chair according to claim 1, wherein the back rest link and the two first supports are integrally formed as a single unitary structure, wherein the seat rest link and the two second supports are integrally formed as a single unitary structure, and wherein the rail link and the two bottom rails are integrally formed as a single unitary structure.

9. The portable chair according to claim 1, wherein the bottom surfaces of the bottom rails are arcuate defining a rocking surface for the portable chair.

10. The portable chair according to claim 1, wherein the first supports, second supports, and the seat rest, back rest and rail links are molded from a thermoplastic material.

11. The portable chair according to claim 1, wherein the first supports, second supports, and the seat rest, back rest and rail links are fabricated from wood.

12. The portable chair according to claim 1, wherein the seat rest, back rest and rail links are each connected, respectively, to the second supports, first supports and bottom rails in a manner comprising at least one of an adhesive material, threaded fasteners, nails, a tongue and groove arrangement, staples, and a dowel arrangement.

13. The portable chair according to claim 1, wherein the flexible sling is suspended from the seat rest link and the back rest link by its opposed ends.

14. The portable chair according to claim 1, wherein the back rest link is connected between the first supports adjacent the top ends.

15. The portable chair according to claim 1, wherein the seat rest link is connected to the upper ends of the second supports.

* * * * *